US006219862B1

(12) United States Patent
Horcher et al.

(10) Patent No.: US 6,219,862 B1
(45) Date of Patent: Apr. 24, 2001

(54) DEVICE FOR MOVEMENT/TRANSPORT OF A PERSON

(75) Inventors: Willi Horcher, Schöneck; Stefan Horcher, Nidderau, both of (DE)

(73) Assignee: Horcher GmbH, Nidderau (DE)

( * ) Notice: Subject to any disclaimer, the term of this patent is extended or adjusted under 35 U.S.C. 154(b) by 0 days.

(21) Appl. No.: 09/306,838

(22) Filed: May 7, 1999

(30) Foreign Application Priority Data

May 8, 1998 (DE) ..... 198 20 508

(51) Int. Cl.[7] ..... A61G 1/00
(52) U.S. Cl. ..... 5/89.1; 5/81.1 R; 5/83.1
(58) Field of Search ..... 5/81.1 R, 89.1, 5/83.1, 86.1; 414/921

(56) References Cited

U.S. PATENT DOCUMENTS 2,339,007 * 1/1944 Gahm ..... 5/81.1
3,234,568 * 2/1966 Fischer ..... 5/89.1
4,420,052 * 12/1983 Hale ..... 5/86.1
5,327,592 * 7/1994 Stump ..... 5/81.1
5,388,289 * 2/1995 Casperson ..... 5/83.1 X
5,649,329 * 7/1997 Horcher et al. ..... 5/83.1
5,809,591 * 9/1998 Capaldi et al. ..... 5/83.1

FOREIGN PATENT DOCUMENTS 192602 7/1996 (NL) .

* cited by examiner

*Primary Examiner*—Terry Lee Melius
*Assistant Examiner*—James M Hewitt
(74) *Attorney, Agent, or Firm*—Dennison, Scheiner, Schultz & Wakeman

(57) ABSTRACT

A device (10) for movement/transport of, in particular, a handicapped person (12), including a transport device such as a patient lifter or lifting unit with a holder (16) in which a slide rail (20), from which attachments for a carrying sling (14) extend, moves under gravity.

14 Claims, 7 Drawing Sheets

FIG. 8
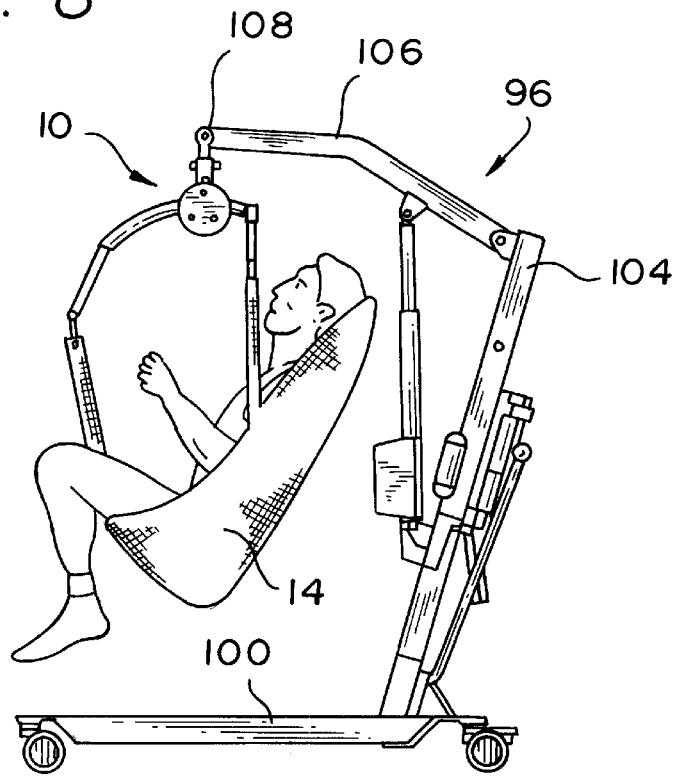
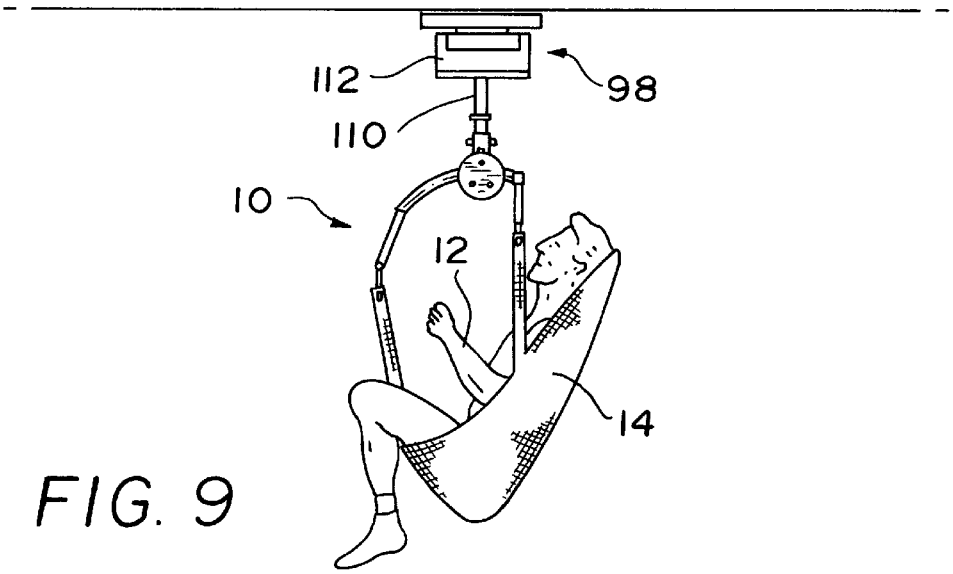
FIG. 9

DEVICE FOR MOVEMENT/TRANSPORT OF A PERSON

FIELD OF THE INVENTION

The invention relates to a device for movement/transport of in particular a handicapped person, comprising a transport device such as a patient lifter or lifting unit, a holder extending from the transport device as necessary via a strap or a journal for at least one head-end and one foot-end bracket element with attachments for a carrying element such as a sling for holding the person, where the bracket elements are adjustable and swivelable relative to the holder such that the person in the carrying element can be moved from a lying position to a sitting or approximately sitting position and vice versa.

BACKGROUND OF THE INVENTION

A corresponding device is known from NL 192602. Here a holder in which three gears forming a transmission are arranged extends from a journal. Arms extend from the outer gears, at the end of which arms bracket elements are arranged that in turn have attachment elements for a carrying sling. It is achieved by the central gear, arranged between the outer gears and meshing with these, that the swiveling action of the arms connected to the bracket element is synchronous. The transmission makes it possible to swivel a person from a lying position to a sitting position and vice versa, however the design has the drawback that the forces transmitted via the gears necessitate regular servicing to ensure proper functioning. If however one of the gears is damaged, the device can no longer be used.

The problem underlying the present invention is to develop a device of the type mentioned at the outset such that problem-free movement of a person from a lying to a sitting position and vice versa is possible without the need for transmission elements requiring regular servicing. At the same time, it should be possible for the person to move to the required position himself/herself without outside assistance.

SUMMARY OF THE INVENTION

The problem is solved in accordance with the invention substantially in that the bracket elements extend from the first and second ends of at least one slide rail that passes through a holder in sliding form, in that the slide rail is either arc shaped with its center point in the area of the person to be transported, or straight, and in that the attachment points for the carrying element are arranged relative to the slide rail such that when the person is unsupported the slide rail is movable inside the holder by gravity such that the person takes up a substantially sitting position.

In accordance with the invention, automatic movement of a person takes place depending on that person's position, to the extent that when the person is lifted out of the lying position automatic movement to the sitting position, takes place, by means of the slide rail being moved automatically inside the holder by gravity such that the foot-end attachment points are lowered and the head-end attachment points of the holding sling or cloth are lifted. The result is an automatic movement of the person from a lying position to a sitting one. Conversely, when the person is set down on a horizontal surface, adjustment of the slide rail inside the holder takes place as the holder is further lowered, so that the person is lain down and can then be removed without difficulty from the sling element. Here the holder is, with a straight slide rail, rotatable about an axis running perpendicular to the movement path of the slide rail to the extent that the necessary gravity-related swiveling of the slide rail and hence its sliding movement inside the holder is possible for movement of the person. The rotary movement itself can be limited by stops.

In a further development of the invention, it is provided that the holder comprises two receptacles rigidly connected to one another for one slide rail each, the receptacle itself having a guide channel for the sliding elements limiting the slide rail, said elements preferably being designed as wheels or castors and having a circumferential recess such as a guide groove. As a result, the sliding element is guided securely inside the receptacle, so that low-friction adjustment is possible by the rolling of the sliding elements.

The receptacles themselves can be rotatable to the necessary extent separately or as a unit via their connection in the case of straight slide rails.

In the case that rollers are used as sliding elements, it is provided that at least three rollers running in one plane are provided per receptacle, with two rollers to be supports for the slide rail and a third roller between the two others above the slide rail.

The rotation point of each receptacle should be in the lower part or below the slide rail.

The receptacles having the guide channels for the slide rails should themselves be preferably connected by a rod such as a tube, which in turn is connected to the transport device, such as patient lifter or ceiling lifter.

According to a further development of the invention, it is provided that the foot-end bracket element has a preferably trapezoidal or triangular frame whose one base line is connected to the first ends of the slide rails and from whose opposite base line or tip extends the foot-end attachment for the carrying element. Here the foot-end attachment can be swivelable relative to the frame.

Furthermore, a head-end bracket element should extend, preferably in articulated form, from every further second end of the slide rails; this bracket element has in turn a head-end attachment for the carrying element in each case.

This ensures an automatic alignment of the bracket elements to the position to the person to be lifted or moved, as a result of which the slide rail is in turn moved to the necessary extent inside the guide channel.

The attachments themselves can be so-called clips to which the carrying element is attached.

To ensure that the person in the sitting position is not swiveled into a possibly not very stable or comfortable position by externally exerted forces, it is provided that a strap or another element with the same effect extends from the head-end area of the carrying element or at least from a head-end bracket element or a head-end attachment; this strap or equivalent element is connectable to the tube running between the receptacles when the person is in the sitting position. This ensures that the slide rails can no longer be adjusted inside the holders such that the person is shifted to a lying position.

As an alternative or supplement thereto, a temporary connection by, for example, a strap such as a double strap can be made from the foot-end bracket element, in particular from a frame section such as base line or tip at a distance from the slide rail. As a result the person can be transported in the lying position, since the slide rail cannot then be adjusted under the force of gravity. It is also possible to provide receptacles in the strap by sewing, said receptacles being fittable to a hook extending from the foot-end bracket element in order to set a required inclination angle for the person being transported.

A particularly smooth automatic movement of a person from a lying to a sitting position and vice versa is achieved when the slide rail has a radius r of 400>r>250 mm, in particular 350>r>300 mm.

Further details, advantages and features of the invention are shown not only in the claims and in the features they contain—singly and/or in combination—but also in the following description of a preferred embodiment shown in the drawing.

BRIEF DESCRIPTION OF THE DRAWINGS

In the drawing,

FIG. 8 shows a patient lifter, and, FIG. 9 shows a ceiling lifter.

DETAILED DESCRIPTION OF THE PREFERRED EMBODIMENTS

Figure 1:
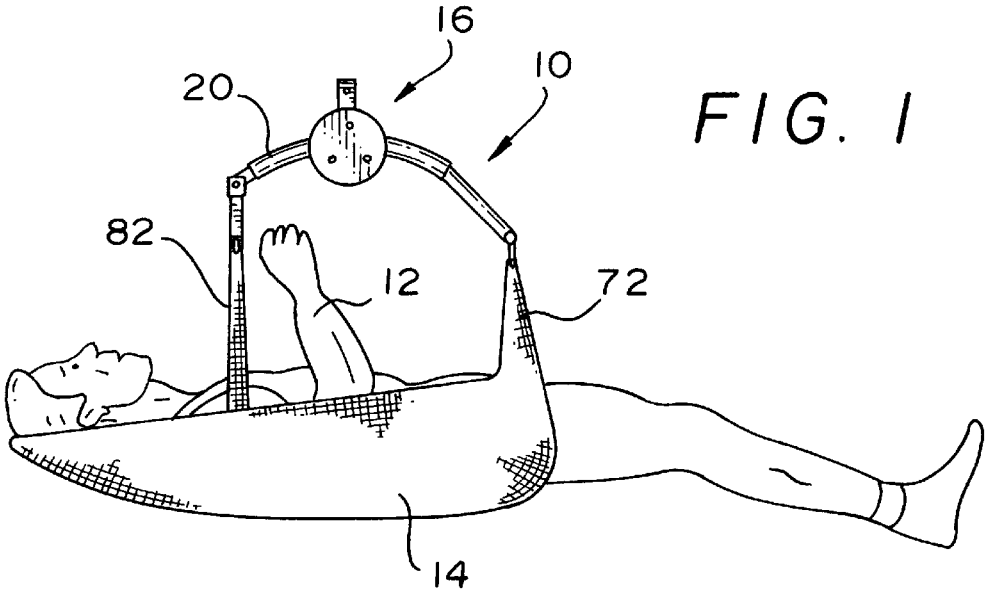
FIG. 1 shows principle view of a sitting/lying bracket in a position holding a person in a lying position.
Figure 2:
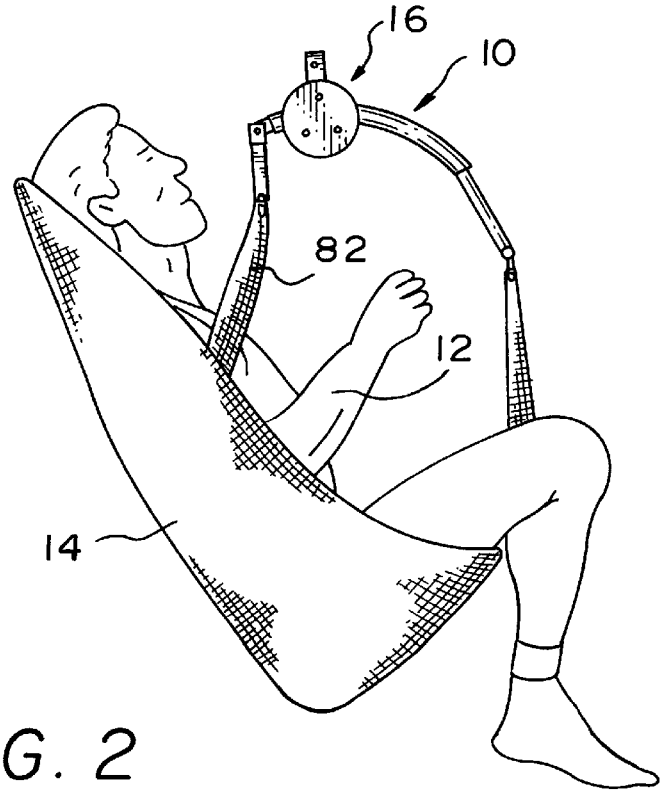
FIG. 2 shows the sitting/lying bracket according to FIG. 1 in a position holding a person in a sitting position.
Figure 3:
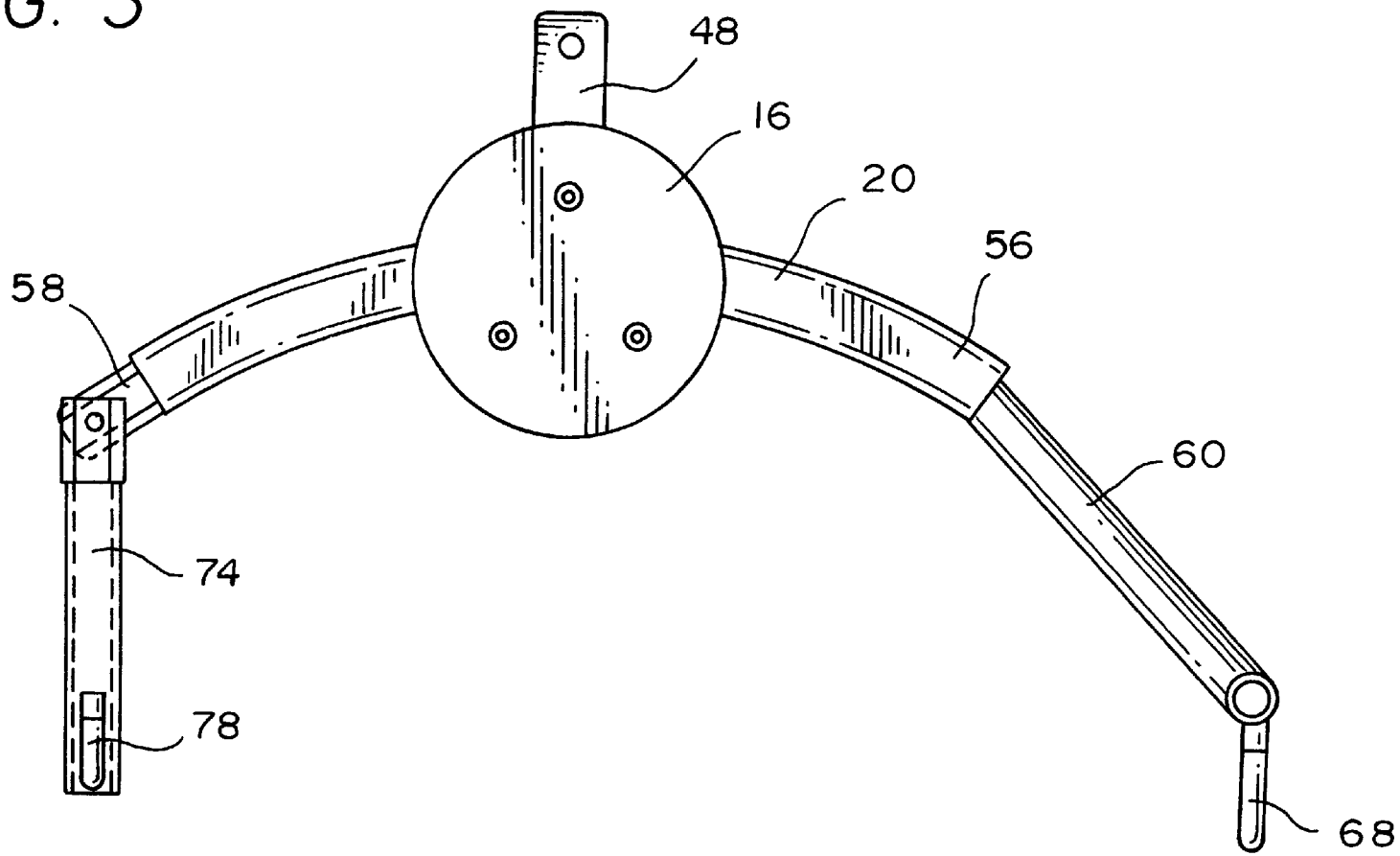
FIG. 3 shows a side view of the sitting/lying bracket according to FIGS. 1 and 2.

FIGS. 1 and 2 show a sitting/lying bracket 10 purely in principle, with which a person 12 held by a carrying sling 14 can be swiveled automatically by gravity from a lying position to a sitting position, regardless of whether the person 12 is lying on a horizontal surface or is at a distance from the latter.

The sitting/lying bracket 10 has as its main element two slide rails or brackets 20, 22 each held in sliding form by a receptacle 16, 18 and slidably adjustable inside the receptacles 16, 18 in guide channels 34, 36 limited by rollers 24, 26, 28, 30, 32. Here the slide rail 20, 22 is curved in accordance with the embodiments in FIGS. 1 to 6, with the curvature center points being at the level of the person 12 to be transported, in particular of the person's back or seat.

Figure 5:
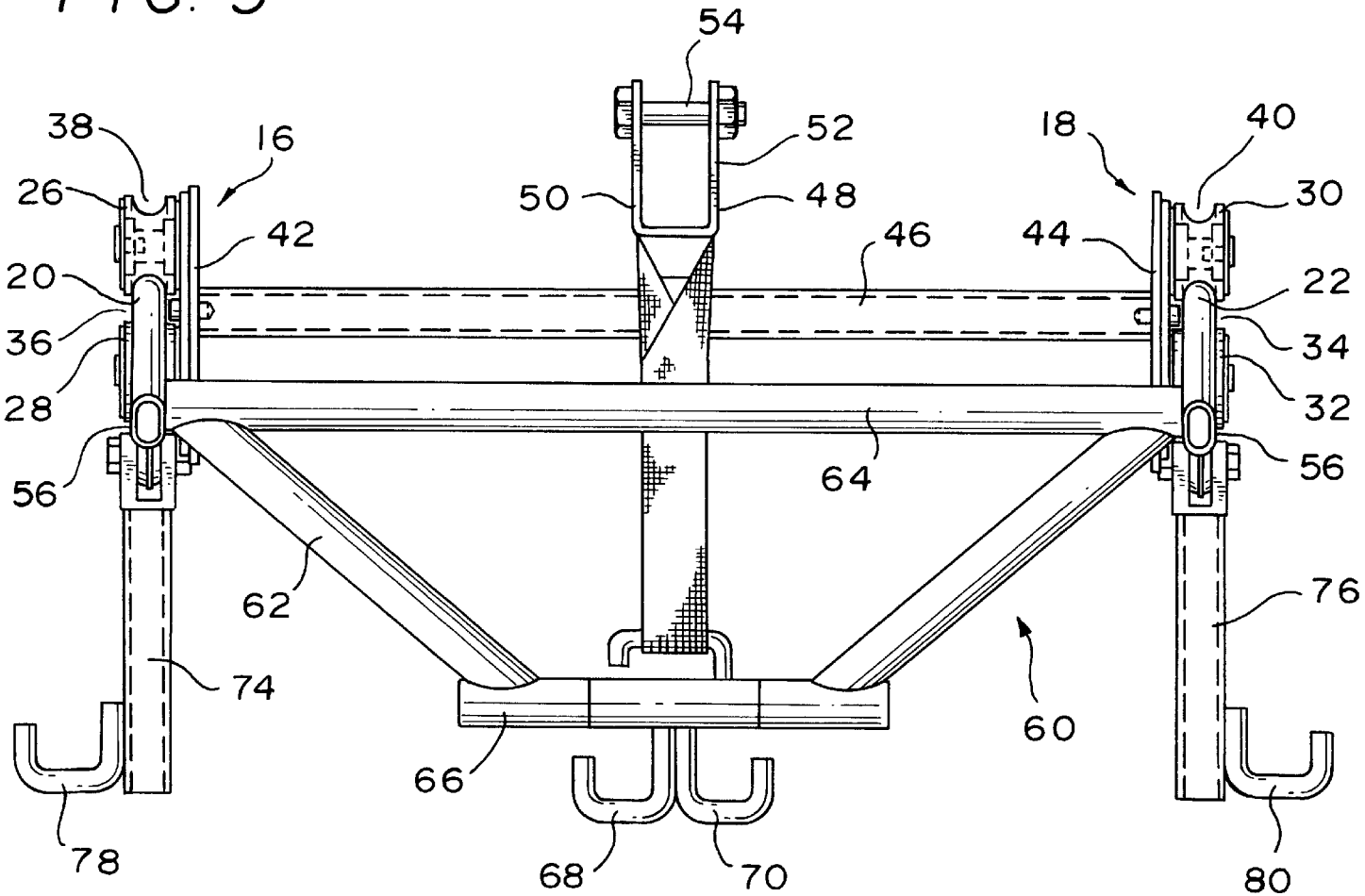
FIG. 5 shows the sitting/lying bracket according to FIGS. 1 and 2 in a front view.

As shown by the front view according to FIG. 5 with the cover of the receptacles 16, 18 removed, the rollers 24, 26, 28, 30, 32 have on the circumferential side central recesses, provided by way of example with the reference numbers 38 and 40, with the geometry being adapted to the outer geometry of the slide rails or brackets 20, 22. The recesses 38, 40 accordingly form guide channels for the slide rails or brackets 20, 22.

The rollers 24, 26, 28, 30, 32 are mounted rotatably in plate-like holders 42, 44 of the receptacles 16, 18, which in turn are connected by a tube 46 which has an attachment 48 that is connected by a strap or journal, not shown, to a ceiling lifter or other transport device for handicapped persons. The attachment comprises two shackles through which passes a journal 52.

Figure 4:
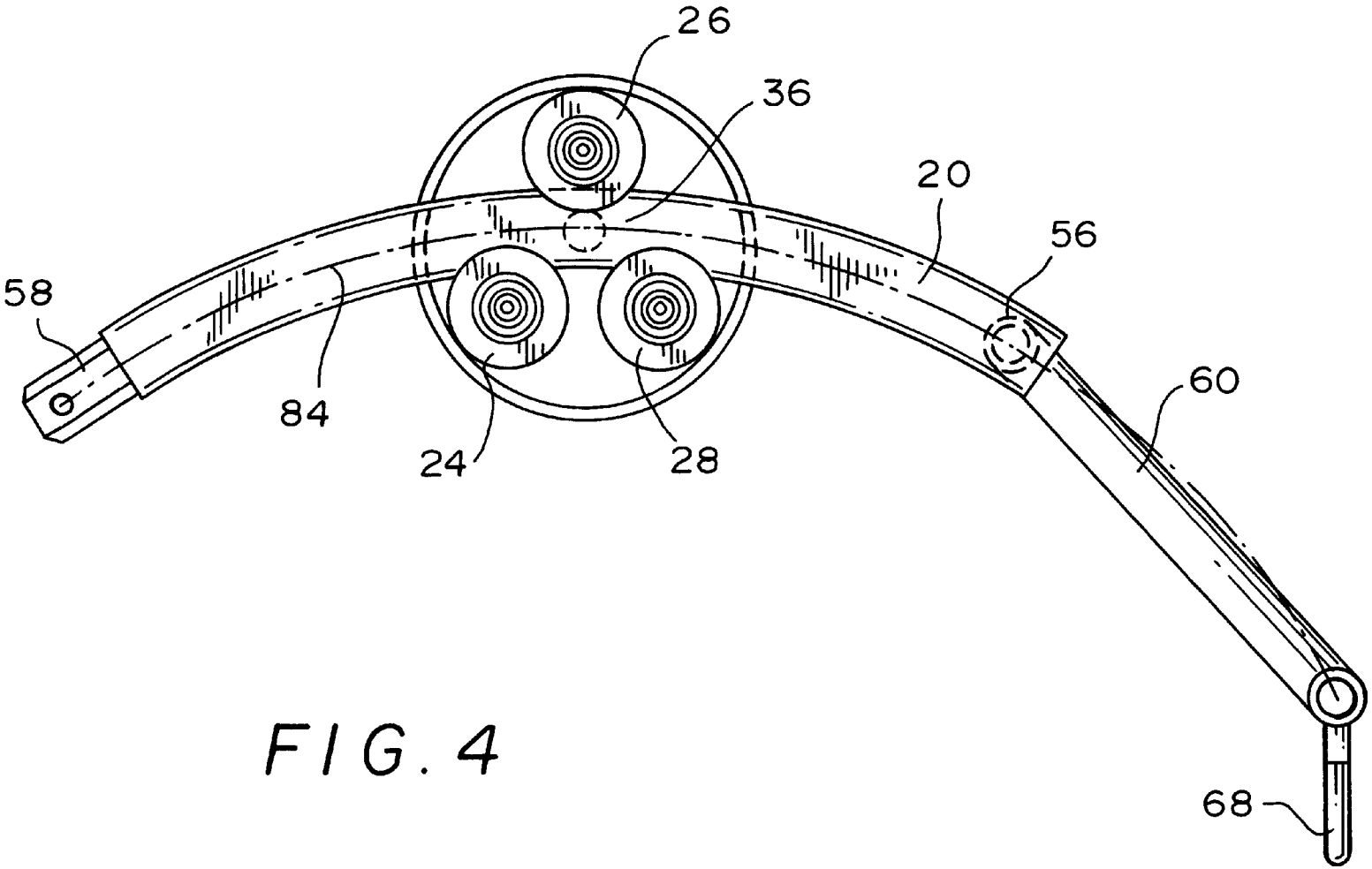
FIG. 4 shows a section of the sitting/lying bracket according to FIG. 3 with covering hood removed from a receptacle holding the slide rail in sliding form.

As explained in the following using the slide rail 20, a bracket element 60, 74 extends from the respective end 56, 58 of a respective slide rail 20, 22 and forms the attachment for the carrying sling 14. The foot-end bracket element 60 is shown in more detail in FIG. 5. The bracket element 60 is formed by a trapezoidal frame 62 whose base line 64 is connected in articulated form to the ends 56 of the slide rails 20, 22. Hook-like attachments 68, 70 in which the carrying sling 14 is fastened with its foot ends 72 then extend from the shorter base line 66. The hook-like attachments 68, 70 can be swivelable relative to the frame 62, as indicated by FIG. 4. Instead of hook-like attachments, clips or other suitable attachment elements can also be used.

A rod/tube-like bracket element 74, 76 with outward-facing hook-like attachment element 78, 80 extends from the respective opposite end section 58. The bracket element 74, 76 can also be connected in articulated form to the end section 58 of the slide rail 20, 22 or to a section connected to that end section and not shown in detail.

If the person 12 is in the position shown in FIG. 2, a strap or belt extending from one of the attachments 78, 80 or from the carrying sling 14 or head-end strap 82 can be suspended from the journals 54 of the holder 48, thereby ensuring that the slide rails 20, 22 cannot be adjusted by uncontrolled forces acting on the person 12.

Figure 6:
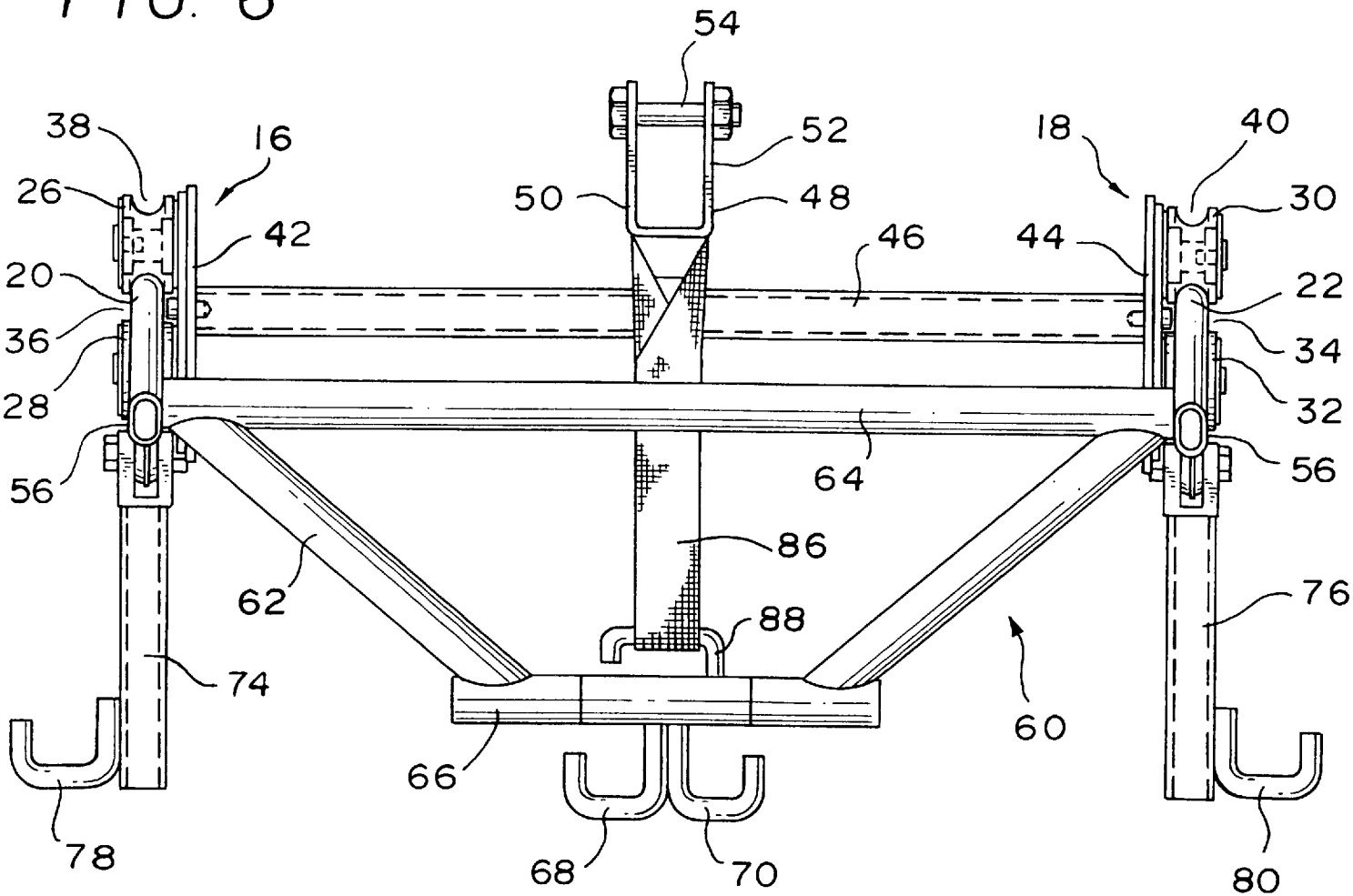
FIG. 6 shows an alternative to the illustration according to FIG. 5.

As FIG. 6 makes clear, it is also possible to connect the foot-end bracket element 16 via a strap 86 to the holder 48 or to the tube 46, thereby preventing movement of the slide rails 20, 22 relative to the receptacles 16, 18. This has the advantage that the person can be transported in a lying or inclined position. The strap 86 has loops, not shown in detail, through which can pass a hook 88 or element of equivalent effect extending from the base line 66 of the frame 60, thereby setting/altering the effective length of the strap 86 and hence the transport position of the person 12.

The sitting/lying bracket 10 in accordance with the invention permits the person 12 to be swiveled by gravity from a lying to a sitting position. If the person 12 is lifted from a horizontal surface, the slide rail 20, 22 in the embodiment moves by gravity clockwise in the guide channels 34, 36, which are as already mentioned defined by the slide rollers 24, 26, 28, 30, 32 so that a continuous movement of the person 12 into a sitting position (FIG. 2) takes place. This gravity-related swivel movement takes place automatically without the need for a transmission or similar mechanical devices. The result is risk-free movement, where it is always assured that the sitting/lying bracket 20 is working properly.

In particular, it is provided that the slide rail or sliding bracket 20, 22 has a curvature radius in the range between 300 and 350 mm, with the center point being, as already mentioned, in the area of the person 12 to be lifted. The bracket element 60 having on the foot end a trapezoidal frame 62 in the embodiment should be designed as an extension of the slide rails 20, 22. The bracket element 60 should preferably form a rigid unit with the slide rails 20, 22, thereby ensuring that the application point on the foot-end bracket 60 is always at the necessary distance from the guide channels 34, 36 formed by the guide rollers 24, 26, 28 or 30, 32, thereby ensuring the necessary gravity-related movement of the slide rail 20, 22 inside the receptacles 16, 18.

Figure 7:
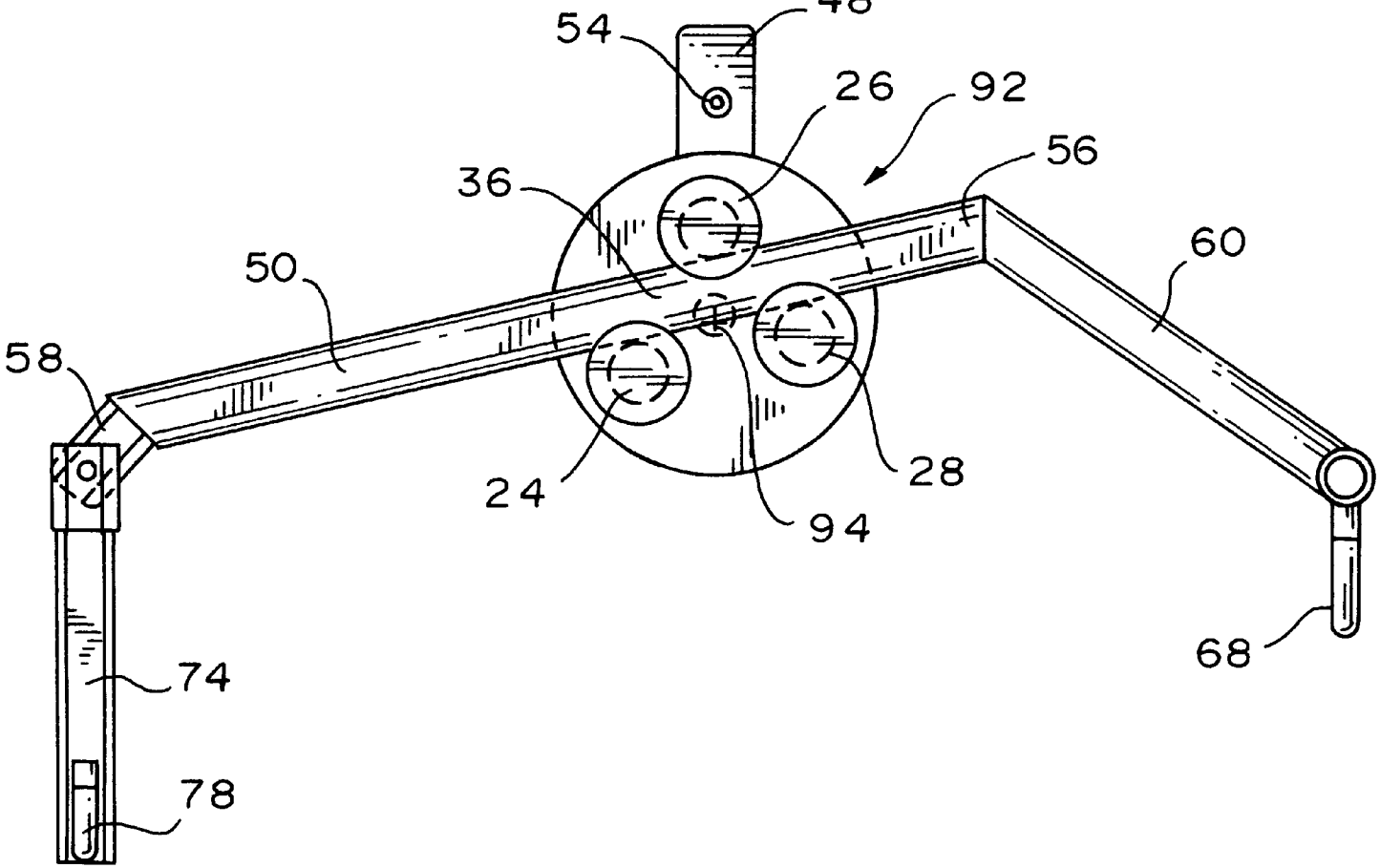
FIG. 7 shows a further embodiment of a sitting/lying bracket.

Instead of curved slide rails 20, 22, it is possible in accordance with FIG. 7 to have straight slide rails 90 passing through receptacles 92, the latter having a guide channel 36 formed by rollers 24, 26, 28 in accordance with the embodiments of FIGS. 1 to 6. However, the receptacle 92 is rotatable about an axis 94, where the rotation angle can be limited by stops, not shown. The axis 94 should furthermore be in the lower area of the slide rail 90. The rotatable design of the receptacle 92 and the straight design of the slide rails 90 result in the same effect as that in FIGS. 1 and 6, where the slide rails 20, 22 are curved and the receptacles 16, 18 are generally non-rotatable. In all other respects the design of FIG. 7 corresponds to that of FIGS. 1–6, so reference is made to the disclosure relating to the latter.

FIGS. 8 and 9 show applications for the teachings in accordance with the invention and in connection with a patient lifter 96 or a ceiling lifter 98 having adequate designs. The patient lifter 96 therefore has a mobile tripod foot 100 from which extends a tripod column 104 that is connected in articulated form to an arm 106, from whose free front end 108 extends the sitting/lying bracket 10 of the type previously described.

The sitting/lying bracket 10 is, in accordance with FIG. 9, connected to a cable hoist 110 of the ceiling lifter 98 that extends from a trolley 112 movable along a rail running across a ceiling.

What is claimed is:

1. A device for movement of a person, comprising a transport device, a slide rail holder connected to said transport device, at least one slide rail (20, 22, 90) slidably supported by said slide rail holder and having first and second ends (56, 58), at least one head-end and one foot-end bracket element (74, 60) attached to said first and second ends (56, 58) of said slide rail and including attachments (68, 70, 78, 80) for a carrying element for holding the person, where the head-end and foot-end bracket elements are adjustable and swivelable relative to the slide rail such that the person in the carrying element can be moved from a lying position to a sitting position and vice versa, wherein, the slide rail is arc-shaped and includes a longitudinal axis along its length, said axis running in the direction from the person's head toward the person's feet and wherein the attachments (68, 70, 78, 80) for the carrying element (14) are arranged relative to the slide rail such that when the person is lifted from a support surface the slide rail moves inside the holder by gravity such that the person assumes a substantially sitting position.

2. Device according to claim 1 wherein the foot end bracket element (60) has a trapezoidal frame (62) having a first portion (64) connected to the first end (56) of the slide rail (20, 22) and having a second portion (66) connected to a foot end attachment (68, 70) for the carrying element.

3. Device according to claim 1, wherein the head-end bracket element (74, 76) is articulated and extends, from the second end (58) of the slide rail (20, 22), said bracket element comprising a head-end attachment (78, 80) for the carrying element (14).

4. Device according to claim 1, wherein a connecting element extends from the head-end bracket element (74, 76).

5. Device according to claim 1 wherein an adjustable strap extends from the foot-end bracket element (60) to the side rail holder (48) of the transport device.

6. Device according to claim 5, wherein the strap (86) has receptacles for a hook element extending from the foot-end bracket element (60) for length adjustment of the strap (86).

7. Device according to claim 1, wherein the slide rail (20, 22) has a radius r of 400<r<250 mm, in particular 350<r<300 mm.

8. Device according to claim 1 wherein the foot end bracket element (60) has a triangular frame (62) having a first portion (64) connected to the first end (56) of the slide rail (20, 22) and having a second portion (66) connected to a foot end attachment (68, 70) for the carrying element.

9. Device according to claim 1, wherein the slide rail (20,22) has a radius of 350>r>300 mm.

10. A device for movement of a person, comprising a transport device, a slide rail holder connected to said transport device, at least one slide rail (20, 22, 90) slidably supported by said slide rail holder and having first and second ends (56, 58), at least one head-end and one foot-end bracket element (74, 60) attached to said first and second ends (56, 58) of said slide rail and including attachments (68, 70, 78, 80) for a carrying element for holding the person, where the head-end and foot-end bracket elements are adjustable and swivelable relative to the slide rail such that the person in the carrying element can be moved from a lying position to a sitting position and vice versa, wherein, the slide rail is arc shaped and wherein the attachments (68, 70, 78, 80) for the carrying element (14) are arranged relative to the slide rail such that when the person is lifted from a support surface the slide rail moves inside the holder by gravity such that the person assumes a substantially sitting position; wherein the slide rail holder comprises two receptacles (16, 18) rigidly connected to one another and wherein said at least one slide rail comprises two slide rails; and wherein each receptacle (16, 18) has a guide channel (34, 36) corresponding to each slide rail (20, 22) that is defined in part by rollers (24, 26, 28, 30, 32).

11. Device according to claim 10, wherein each receptacle (16, 18) comprises at least three rollers (24, 26, 28, 30, 32) positioned in one plane.

12. Device according to claim 11, wherein each slide rail (20, 22) is supported on first and second rollers (24, 28, 32) on one side of each of the rails and another roller (26, 30) is positioned on the opposite side of the rails from said first and second rollers.

13. Device according to claim 10, wherein the receptacles (16. 18) are connected by a rod (46), which in turn is connected to the transport device.

14. A device for movement of a person comprising:

a transport device;

a slide rail holder (16, 18) connected to said transport device;

at least one slide rail (20, 22, 90) slidably supported by said slide rail holder and having first and second ends (56, 58), at least one head-end and one foot-end bracket element (74, 60) attached to said first and second ends (56, 58) of said slide rail and including attachments (68, 70, 78, 80) for a carrying element for holding the person, the head-end and foot-end bracket elements being adjustable and swivelable relative to the slide rail such that the person in the carrying element can be moved from a lying position to a sitting position and vice versa, wherein, the slide rail is straight and includes a longitudinal axis, said axis running in the direction from the person's head toward the person's feet, and the attachments (68, 70, 78, 80) for the carrying element (14) are arranged relative to the slide rail such that when the person is lifted from a support surface the slide rail moves inside the holder by gravity such that the person assumes a substantially sitting position.

* * * * *